United States Patent [19]

Willim

[11] 4,249,590

[45] Feb. 10, 1981

[54] METHOD FOR CONTINUOUS CASTING

[75] Inventor: Fritz Willim, Birmensdorf, Switzerland

[73] Assignee: Concast AG, Zurich, Switzerland

[21] Appl. No.: 889,096

[22] Filed: Mar. 22, 1978

[30] Foreign Application Priority Data

Apr. 6, 1977 [CH] Switzerland ..... 4351/77

[51] Int. Cl.[3] ..... B22D 11/04; B22D 11/16

[52] U.S. Cl. ..... 164/82; 164/4; 164/418; 164/449

[58] Field of Search ..... 164/82, 418, 449, 4, 164/450

[56] References Cited

U.S. PATENT DOCUMENTS 3,842,894 10/1974 Southworth et al. ..... 164/449 X 3,926,244 12/1975 Meier ..... 164/4

FOREIGN PATENT DOCUMENTS 2409820 9/1975 Fed. Rep. of Germany ..... 164/418

*Primary Examiner*—Robert D. Baldwin
*Assistant Examiner*—Gus T. Hampilos
*Attorney, Agent, or Firm*—Werner W. Kleeman

[57] ABSTRACT

A method of continuous casting of metals, especially steel, wherein the steel is cast into a continuous casting mold having at least two taper stages or regions which are successively arranged in the direction of travel of the cast strand. In order to accommodate the shrinkage behavior of the forming strand to different casting parameters the bath level in the continuous casting mold is altered within a number of such taper stages or regions.

8 Claims, 1 Drawing Figure

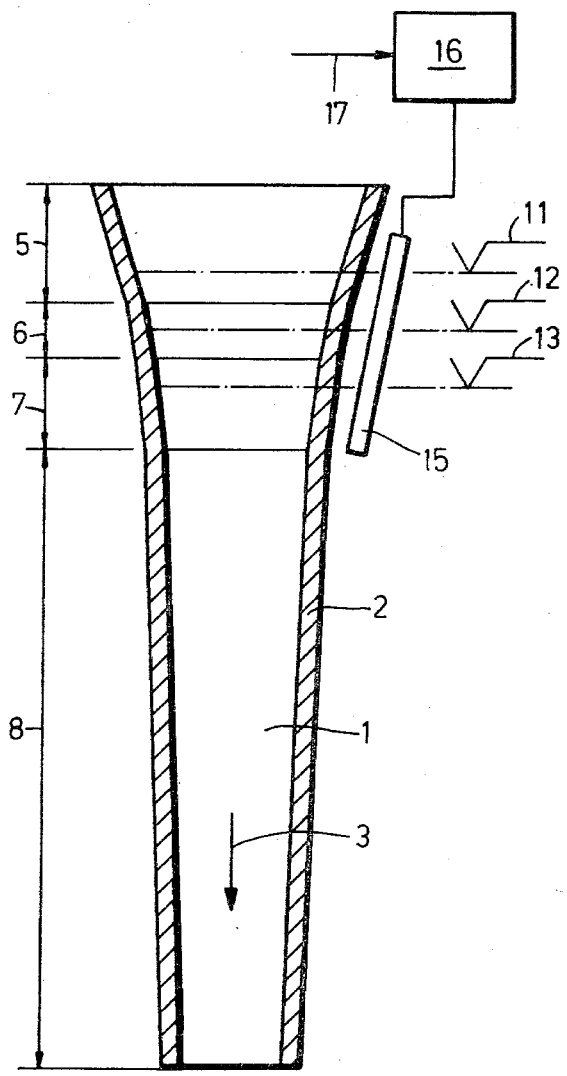
16
17
11
12
13
5
6
7
15
2
8
1
3

METHOD FOR CONTINUOUS CASTING

BACKGROUND OF THE INVENTION

The present invention broadly relates to the continuous casting art, and, more specifically, concerns a new and improved method of continuously casting metals, especially steel, wherein steel is cast into a continuous casting mold having at least two taper stages or regions which follow one another in the direction of travel of the cast strand, and furthermore, this invention also concerns apparatus for the performance of the aforesaid method.

The shrinkage behavior, during the casting of steel strands having the same cross-section, is dependent upon the casting parameters, such as the composition of the melt, the casting speed, casting temperature and casting process, such as for instance whether casting is accomplished with or without flux powder. During the production of continuously cast strands frequently the taper of the continuous casting mold is accommodated to the shrinkage behavior of different steel qualities and the contemplated casting speed. Apart from thereby achieving a reduced tendency of metal break-out there is furthermore obtained optimum cooling of the strand, which, in turn, ensures for good quality of the cast strand product.

During the continuous casting of steel billets and blooms it is known from practice to use tube molds having an appropriately conically configured hollow mold cavity or compartment. On the one hand, the taper thereof is accommodated to the strand or cross-section and, on the other hand, to the steel quality as well as the contemplated mean or average casting speed. If, for instance, the steel quality is altered from conventional carbon steels to austenitic or other alloyed steels, then the different shrinkage behavior of these two types of steels is taken into account by exchanging the mold for an appropriately designed casting mold.

During the continuous casting of steel with plate molds there is furthermore known to the art a method which contemplates accommodating the taper of the hollow mold compartment between both of the narrow sides of the mold also during the casting operation upon change of the casting parameters. This method which is suitable for the casting of slab shapes cannot be employed when casting billet sections and square bloom sections as well as during casting in tube molds.

In order to avoid longitudinal fissures, especially edge fissures, and to reduce the danger of metal break-out with increased casting speed, it is further known in this field to limit the converging hollow mold compartment by means of walls having parabolic-shaped surfaces. The parabolic-shaped surfaces of the inner walls of the mold can also be bounded by step-shaped, planar surfaces, so that, viewed in the direction of travel of the strand, there are formed successive taper stages or regions, the degree of taper of which reduces in the direction of strand travel. At the region of the cast molten bath level or meniscus the hollow mold compartment is provided with parallel walls. This multiple-conical hollow mold compartment is designed for predetermined steel composition, casting speed and mold length. When casting steel charges of different composition and so forth, it is necessary to exchange such molds, thereby reducing the available production capacity of the continuous casting installation.

SUMMARY OF THE INVENTION

Therefore, with the foregoing in mind it is a primary object of the present invention to provide an improved method of and apparatus for continuous casting of metals, especially steel, which is not associated with the aforementioned drawbacks and limitations of the prior art proposals.

Another and more specific object of the present invention aims at providing a new and improved method of, and apparatus for continuous casting of metals, enabling casting steel charges with different casting parameters in succession without the need to exchange the mold.

Yet a further significant object of the present invention, and in keeping with the foregoing, is to enable optimum accommodation of the taper of the hollow mold compartment to the different shrinkage behavior of different types of steels, in order to thereby ensure for optimum quality of the cast strand.

Still a further object of the present invention aims at providing a continuous casting method affording high production availability or capacity for the casting installation and providing considerable flexibility in the determination of the casting speed as needed for sequential pours.

Now in order to implement these and still further objects of the invention, which will become more readily apparent as the description proceeds, the method aspects of the present invention are manifested by the features that in order to accommodate the shrinkage behavior of the strand which is being formed to different casting parameters there is altered the height of the bath level in the continuous casting mold within a number of taper stages or regions.

The inventive method enables effectively accommodating the hollow compartment-taper of the continuous casting mold, and which taper is decisive for the formation of the strand, to different steel compositions, without the need to alter the dimensions of the hollow mold compartment of the continuous casting mold or having to exchange the latter. Furthermore, the method allows for optimum accommodation of the taper which is effective for strand cooling during a continuous pour with changing casting speed and/or steel temperature, thereby increasing the flexibility of the continuous casting plant or installation. In the case of successive charges cast by employing different casting techniques, such as, for example, with or without flux powder slag, it is equally possible, without reduction of the production capacity i.e. available production time of the casting installation, to select a casting taper which is accommodated to the new conditions. Due to the selection of the optimum casting taper it is possible to improve the strand quality, especially the strand surface quality, and to reduce the danger of metal break-out.

According to a further feature of the invention it is advantageous if the molten bath level is changed within taper stages having degrees of taper between 2.5 %/m and 0.5 %/m. The taper stages or regions with different degrees of taper can be arranged in a random transition curve with steps or interruptions or infinitely.

Not only is the invention concerned with the aforementioned method aspects, but also deals with apparatus for the performance thereof. One exemplary construction of apparatus particularly useful in the practice of the method aspects contemplates that the measuring region of a bath level-measuring device extends over at least two taper stages or regions, whose degree of taper reduces in the direction of strand travel, and that a bath level-regulation device operatively associated with the bath level-measuring device can be adjusted to at least two different reference-bath level heights.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates in cross-sectional view a continuous casting mold and associated bath level-regulation device and bath level-measuring device according to the present invention.

DETAILED DESCRIPTION OF THE PREFERRED EMBODIMENTS

Describing now the drawing it is to be understood that only enough of the construction of a continuous casting installation has been shown in the drawing to enable those skilled in the art to readily understand the underlying principles and concepts of the invention. In the single FIGURE there is illustrated a tube or tubular mold 2 having a hollow mold cavity or compartment 1 which possesses taper stages or regions 5, 6, 7 and 8, by way of example, which extend in the direction of travel of the strand, generally indicated by reference character 3. The degree of taper of the hollow mold compartment 1 of such taper stages or regions 5, 6, 7 and 8 reduces in such strand direction of travel 3. The chain-dot or phantom lines represent three bath level heights 11, 12 and 13.

The degree of taper K in %/m of the taper stages 5, 6, 7 and 8 can be defined by the following equation:

$$K\left(\frac{\%}{m}\right) = \frac{\Delta B}{Bu} \cdot \frac{100}{L}$$

In the above equation ΔB represents the difference in mm of the upper and the lower width of the hollow mold compartment of a taper stage or region, reference character Bu the size in mm of the lower width of the hollow mold compartment of the aforementioned taper stage, and reference character L the length in meters of the same taper stage.

The taper stages or regions 5, 6, 7 and 8, in the exemplary embodiment under discussion, possess for instance the following degree of taper K:

| | |
|---|---|
| Taper Stage 5 | 1.2%/m |
| Taper Stage 6 | 0.9%/m |
| Taper Stage 7 | 0.7%/m |
| Taper Stage 8 | 0.5%/m |

Production of such mold 2 constructed as a tube mold, with a high degree of accuracy, can be readily carried out with existing technology, for instance by deformation upon a mandrel by means of detonation of an explosive material.

Continuous casting according to the method aspects of the invention is accomplished as follows: A charge of carbon steel containing 0.2% carbon is cast at a casting speed of 2.2 m/min. with a strand cross-section of 200×200 mm². In order to obtain optimum quality as concerns good surface characteristics of the strand, low diamond-shape or rhombidity and a well formed internal structure, this charge, at the contemplated casting speed, should be cast in a mold having a mean or average degree of taper of 0.6 %/m. In order to fulfill this condition the bath level for the steel is advantageously maintained within the taper stage or region 7 having a degree of taper of 0.7 %/m at a bath level height 13. At the bath level region within the taper stage 7 the degree of taper of 0.7 %/m is somewhat greater than the average desired degree of taper of 0.6 %/m and at the lower mold part, at the taper stage or region 8 having the degree of taper 0.5 %/m, somewhat therebelow. Such distribution of the degree of taper is desired because near to the bath level there is a greater shrinkage than, for instance at the lower part of the mold 2.

Now without the need for exchanging the mold 2 at the continuous casting installation, it is assumed that upon completion of the casting of this carbon-steel charge there should now be cast a charge of austenitic steel of the alloy group Cr/Ni 18/8 in the same mold 2. The desired mean of average degree of taper of 1 %/m for this steel, with a casting speed of 1.8 m/min. requires a bath level height 11. Thus, the strand which is formed passes in the direction of strand travel 3 the following taper degrees:

- 1.2 %/m approximately during 5% of the mold length
- 0.9 %/m approximately during 5% of the mold length
- 0.7 %/m approximately during 15% of the mold length
- 0.5 %/m approximately during 75% of the mold length The utilized mold length, for this steel charge, is about 15% longer than for the previously mentioned carbon-steel charge, i.e. for the Cr/Ni charge it is 700 mm is contrast to 600 mm for the carbon-steel charge.

With changing casting speed, casting temperature and/or casting technique, such as for instance when using flux powder, there can be additionally realized accommodations to the desired degree of taper by changing the bath level height.

The taper stages 5, 6, 7, 8 and so forth can be freely chosen as concerns their length and can be appropriately accommodated to requirements. As a general rule the taper stages or regions vary between 2.5 %/m and 0.5 %/m.

Instead of the taper stages or steps there also can be chosen a transition curve providing a continuous or stepless transition.

In order to monitor the predetermined bath level heights or bath levels there can be employed conventional bath level-measuring devices, such as radioactive radiation devices, for instance as disclosed in the commonly assigned U.S. Pat. No. 3,537,505, to which reference may be readily had and the disclosure of which is incorporated herein by reference. Furthermore, there are also known to the art measuring devices working on the principle of thermoelements which likewise are suitable for use in the practice of the invention owing to the good possibility afforded therewith of switching to different reference bath level reference-heights or bath levels.

More specifically, in the drawing there is schematically shown a bath level-measuring device or level detector 15 operating according to one of the known measuring principles, such as previously explained. The bath level-measuring device 15 could also be arranged above the tube mold 2. The measuring range of the measuring device 15 extends over at least two taper stages, here over the taper stages or regions 5, 6 and 7, the taper or degree of taper of which reduces in the direction of strand travel 3. Operatively connected with the bath level-measuring device 15 is a conventional bath level-regulation device 16, which again for instance may be of the type disclosed in the aforementioned U.S. Pat. No. 3,537,505 although other systems obviously could be employed. This bath level-regulation device 16 is supplied with a reference-bath level height input signal 17 which renders possible adjusting at least two different reference-bath level heights 11, 12, 13. In order to achieve fine accommodations to the prevailing casting parameters, there also can be provided by way of example an infinite adjustment of the reference-bath level height. The reference-bath level height input signal 17 can be applied manually or computer-controlled as a function of, for instance, continuously measured casting parameters.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of continuously casting metals, especially steel, while taking into account for the cast metal different possible casting parameters, such as composition of the cast metal, temperature of the cast metal, casting speed and casting process, comprising the steps of:

providing a continuous casting mold having a hollow mold compartment and having at least two successive taper stages of differing degrees of taper in a direction of travel of the metal through the continuous casting mold;

continuously casting metal into the continuous casting mold to establish a molten both level in the mold and to form a continuously cast strand; and altering the height of the molten bath level in the continuous casting mold from one taper stage to another and different taper stage in order to accommodate the shrinkage behaviour of the strand which is being formed to different casting parameters of the cast metal, so that with the same continuous casting mold it is possible to cast metal at different casting parameters without the need to alter the dimensions of said hollow mold compartment of said casting mold.

2. The method as defined in claim 1, further including the steps of:

altering the molten bath level height within said taper stages which have degrees of taper ln a range between 2.5 %/m and 0.5 %/m.

3. The method as defined in claim 1, further including the steps of:

utilizing as the continuous casting mold a tubular mold.

4. The method as defined in claim 1, further including the steps of:

utilizing as the continuous casting mold a mold having spatially fixed mold walls.

5. The method of continuously casting metals, especially steel of different compositions in a continuous mold, comprising the steps of:

providing a continuous casting mold having at least two successive taper stages in a predetermined direction of travel of the cast metal through the continuous casting mold;

selecting a first predetermined height of the molten bath level in said continuous casting mold, in order to accommodate the shrinkage behavior of a first composition of the cast steel;

continuously casting metal into the continuous casting mold to establish said first predetermined height of the molten both level in the mold and to form a continuously cast strand of said first composition; interrupting the casting of said first composition;

selecting second predetermined height of the molten bath level in said continuous casting mold different from said first predetermined height in order to accommodate the shrinkage behavior of a second composition of the cast steel;

and, continuously casting metal into said continuous casting mold to establish said second predetermined height of the molten metal both in the mold to form a continuously cast strand of said second composition.

6. The method as defined in claim 5, further including the steps of:

altering a selected predetermined height of the molten bath level in the continuous casting mold during casting, in order to accommodate the shrinkage behavior of a given composition of the cast steel to a changing casting speed.

7. The method as defined in claim 6, further including the steps of:

altering a selected predetermined height of the molten bath level in said continuous casting mold during casting, in order to accommodate the shrinkage behavior of a given composition of the cast steel to a changing temperature of the cast metal.

8. The method as defined in claim 5, further including the steps of:

altering a selected predetermined height of the molten bath level in said continuous casting mold during casting, in order to accommodate the shrinkage behavior of a given composition of the cast steel to a changing temperature of the cast metal.

* * * * *